United States Patent [19]

Essex et al.

[11] Patent Number: 4,881,867

[45] Date of Patent: Nov. 21, 1989

[54] EXCAVATOR ATTACHMENT

[76] Inventors: Stuart A. Essex; Wendy P. Essex, both of 3 Kambalda Place, Yarrawarrah, New South Wales, Australia, 2232

[21] Appl. No.: 240,190

[22] PCT Filed: Sep. 22, 1987

[86] PCT No.: PCT/AU87/00322

§ 371 Date: Jun. 10, 1988

§ 102(e) Date: Jun. 10, 1988

[87] PCT Pub. No.: WO88/02421

PCT Pub. Date: Apr. 7, 1988

[30] Foreign Application Priority Data

Oct. 3, 1986 [AU] Australia ..... PH08317

[51] Int. Cl.[4] ..... E02F 9/00

[52] U.S. Cl. ..... 414/723; 294/93; 294/103.1; 403/322

[58] Field of Search ..... 414/723; 91/420; 403/321, 322; 294/103.1, 93

[56] References Cited

U.S. PATENT DOCUMENTS

| | | | |
|---|---|---|---|
| 3,964,622 | 6/1976 | Blair | 414/723 |
| 3,985,249 | 10/1976 | Aker et al. | 172/272 X |
| 4,442,912 | 4/1984 | Vette | 91/420 X |
| 4,480,955 | 11/1984 | Andrews et al. | 414/723 |

FOREIGN PATENT DOCUMENTS

| | | |
|---|---|---|
| 77154 | 5/1982 | Australia . |
| 18602 | 3/1984 | Australia . |
| 35627 | 5/1985 | Australia . |
| 44122 | 6/1986 | Australia . |
| 62019 | 2/1987 | Australia . |
| 2053142 | 2/1981 | United Kingdom . |

*Primary Examiner*—Robert J. Spar
*Assistant Examiner*—Donald W. Underwood
*Attorney, Agent, or Firm*—Townsend and Townsend

[57] ABSTRACT

A hitch assembly for mounting onto the articulated arm of a hydraulic excavator, backhoe or the like comprising remotely operable jaws (14) for releasibly grasping the hinge pins (15, 16) of a bucket, rock hammer or other device whereby such implements can be quickly and easily interchanged without removal of said pins.

4 Claims, 3 Drawing Sheets

EXCAVATOR ATTACHMENT

This invention relates to construction machines and more particularly although not exclusively to hydraulic excavators or backhoes.

Excavators or backhoes when used for the removal of rock are normally fitted with hydraulic or pneumatic hammers which first break up the material so that it can be subsequently cleared with a bucket. This procedure however requires that the hammer and bucket be fitted alternately to the excavator and the swapping operation can take as long as 40 minutes with those machines which require the removal of the hinge pins normally connecting the hammer or bucket to the arm.

It is an object of this invention to ameliorate this disadvantage and accordingly a hitch assembly is disclosed for mounting onto the articulated arm of a hydraulic excavator or backhoe or the like and comprising remotely operable means for releasibly grasping the hinge pins of a bucket, rock hammer or other device whereby such implements can be quickly and easily interchanged without removal of said pins.

Figure 1:
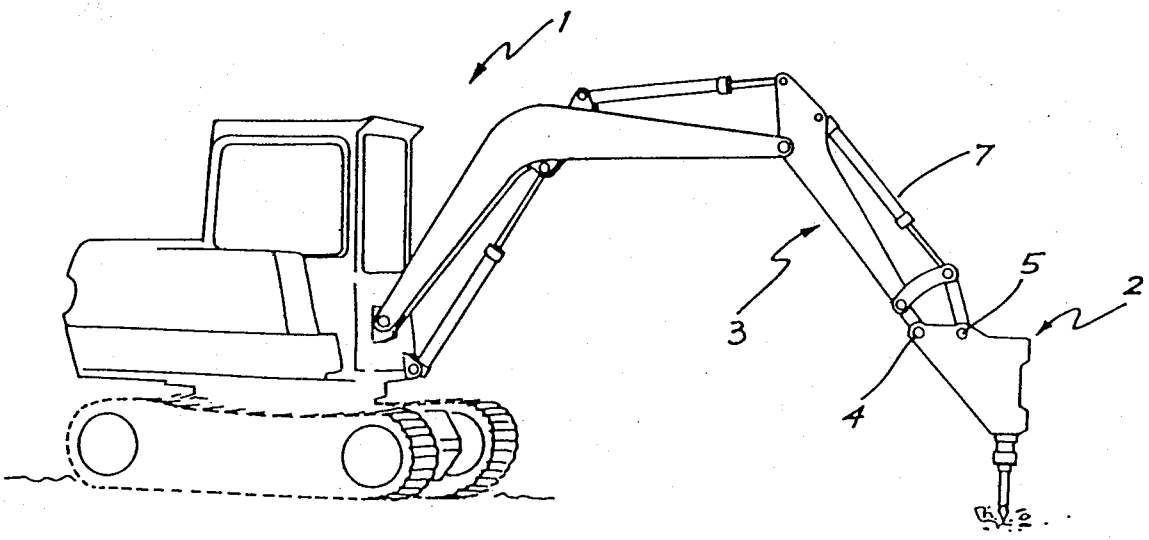
Figure 2:
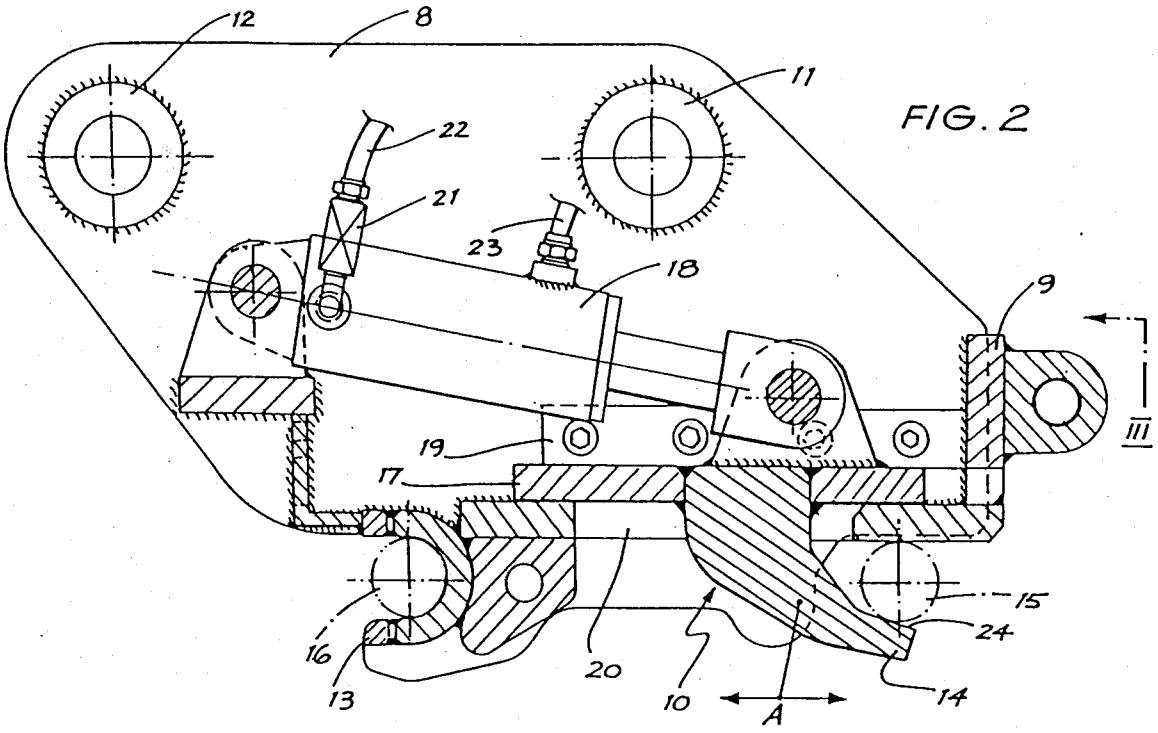
Figure 3:
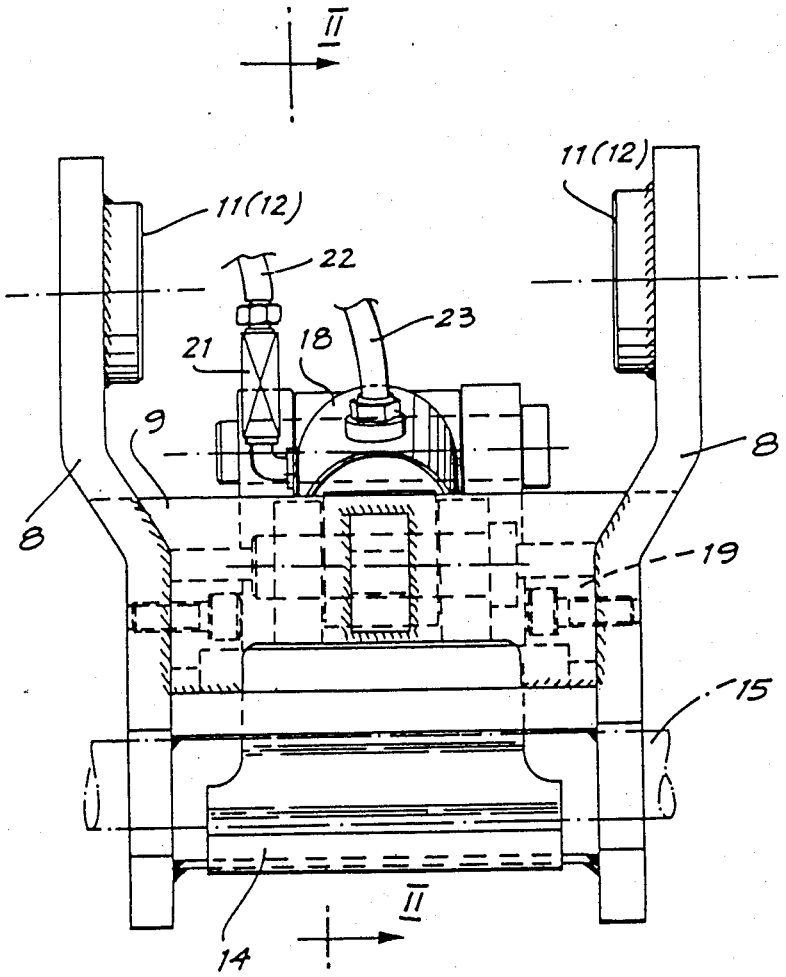

The currently preferred embodiment of this invention will now be described with reference to the attached illustrations in which:

FIG. 1 shows a conventional mounting for a rock hammer on a hydraulic excavator, FIGS. 2 and 3 show side and end views of a hitch assembly according to this invention which may be fitted between the hammer and articulated arm of the excavator of FIG. 1.

Referring first to FIG. 1 a hydraulic excavator is indicated generally by the numeral 1 and has a rock hammer 2 mounted in the conventional manner onto the end of the articulated arm 3. The mounting arrangement comprises two parallel hinge or pivot pins 4 and 5 which allow the hammer to be directed at any required angle by the hydraulic ram 7. Although not shown a bucket or other implement could similarly be mounted in place of the hammer 2. With such conventional equipment however this requires the manual removal of each of the pivot pins 4 and 5 before the hammer can be detached from the arm and their subsequent refitting in order to mount another implement in place. The operation is therefore time consuming and laborious and adds significantly to equipment costs on jobs where the change over must be repeated a number of times.

The currently preferred hitch assembly according to this invention comprises a housing with side and end plates 8 and 9 which enclose a hydraulically operable slide mechanism 10 as will be described later. The upper portion of the housing includes two sets of aligned bushings 11 and 12 which are adapted to receive the aforementioned pivot pins 4 and 5. The hitch is thus mountable directly onto the excavator arm in place of the hammer or bucket. The lower portion of the hitch includes a pair of oppositely directed jaws 13 and 14. One of these jaws 13 is fixed and the other is movable in the directions indicated by arrow "A". With this jaw 14 withdrawn inwardly the lower portion of the hitch is thus able to be fitted between the parallel pivot pins of a bucket or hammer. The relative positions and size of these pins 15 and 16 in relation to the jaws 13 and 14 is shown in FIG. 2. In actual use however these pins 15 and 16 would extend through the upper portion of the hammer or bucket assembly. Subsequent outward displacement of the jaw 14 then serves to lock the hitch in place between the pins as shown in FIG. 2.

With this embodiment the displacement of jaw 14 is obtained by means of a slide plate 17 located within the hitch housing. This plate is activated by means of a ram 18 which may be powered directly from the hydraulic system of the excavator. The plate moves within guides formed by ribs 19 along each side of the housing and directly below the plate there is an aperture 20. The jaw 14 is affixed to the plate 17 and extends down through the aperture 20.

The hydraulic circuit for the ram 18 preferably includes a valve assembly to insure that the jaw cannot be withdrawn from the pin 15 until a positive release is required. This is accomplished by means of a one way valve 21 which prevents hydraulic fluid once it enters the ram cylinder through conduit 22 from returning to the system even after a drop in supply pressure. The ram 18 can only be withdrawn by applying a positive pressure through a separate circuit which serves to both release the valve 21 and also act through conduit 23 against the opposite side of the ram piston.

Preferably the upper face 24 of the jaw 14 is inclined at an angle of about 18 degrees to the horizontal to provide a wedging action which serves to lock the hitch onto the pins without an unnecessarily high magnitude of force needing to be applied by the ram 18. This feature is particularly important when a rock hammer is used as the vibrations generated rapidly wear any mating surfaces which are not rigidly secured together.

As shown in FIG. 3 the side plates 8 of the housing preferably taper inwardly towards the lower portion of the hitch. This enables the jaws to interfit with the brackets of existing buckets or rock hammers.

In use the hitch is mounted between a hammer, bucket or other implement and the arm of the excavator. The parallel pins 4 and 5 (see FIG. 1) insert through bushings 11 and 12 to secure the hitch to the arm and the implement or bucket is in turn locked onto the hitch by means of the jaws 13 and 14 as described earlier. The supply conduits 22 and 23 would also be connected to the hydraulic system of the excavator. A speedy and efficient interchange of implements is then possible by simple manipulation of the hydraulic controls of the excavator to thereby withdraw jaw 14 to release one device and subsequently extend it to grasp the pivot pins of the other.

It will thus be appreciated that this invention at least in the form of the embodiment described provides a novel labour saving attachment for construction machinery such as hydraulic excavators, backhoes or the like. Clearly however the particular example disclosed is only the currently preferred form of this invention and a wide variety of modifications may be made which would be apparent to a man skilled in the art. For example the shape and configuration of the housing for the hitch or the jaws may be changed according to design requirements and other mechanically or pneumatically equivalent systems may be substituted for the ram 18. Further a hitch assembly according to this invention is not limited to usage with buckets or rock hammers but may extend to a wide variety of other implements such as augers, drills, tampers, ripping teeth or grader blades.

The claims defining the invention are claimed as follows:

1. A hinge assembly for mounting onto the articulated arm of a hydraulic excavator, backhoe or other excavating machine, the assembly comprising a housing and a remotely operable pair of oppositely directed jaws which are adapted to releasably grip the transverse hinge pins of a bucket, rock hammer or other operating tool for the machine, one of said jaws being fixed and the other being movable between a withdrawn position in which said jaws can be fitted between said hinge pins and an extended position in which said pins are grasped by the jaws, the inner face of said movable jaw being inclined at an acute angle away from an opposite face to provide a wedging action against said opposite face which serves to lock the hitch assembly onto the pins as said movable jaw is displaced to said extended position, both said jaws at all times protruding clear of said housing with said movable jaw being mounted on a slide plate within said housing and said movable jaw protruding clear of said housing through an aperture directly below the slide plate.

2. The hitch assembly as claimed in claim 1 wherein in use said slide plate is moved by a hydraulic ram operated from the hydraulic system of the excavating machine.

3. The hitch assembly as claimed in claim 2 wherein said inner face of said movable jaw is inclined at an angle of about 18 degrees.

4. The hitch assembly as claimed in claim 3 wherein the hydraulic circuit for the ram includes a valve which prevents release of the jaws once engaged even after a drop in supply pressure.

* * * * *